US005193814A

United States Patent [19]

Koch

[11] Patent Number: 5,193,814

[45] Date of Patent: Mar. 16, 1993

[54] GAME BOARD AND METHOD OF USING SAME

[76] Inventor: Grace Koch, 1000 SW. 128th Ter., Cambridge V, Apt. 304, Pemborke Pines, Fla. 33027

[21] Appl. No.: 938,393

[22] Filed: Aug. 31, 1992

[51] Int. Cl.[5] ..... A63F 3/00

[52] U.S. Cl. ..... 273/242

[58] Field of Search ..... 273/242, 243, 248, 249, 273/258, 260, 261

[56] References Cited

U.S. PATENT DOCUMENTS

| | | | |
|---|---|---|---|
| 665,123 | 1/1901 | McLoughlin | 273/242 |
| 2,181,793 | 11/1939 | Sanford | 273/242 |
| 2,320,832 | 6/1943 | Schoenberg et al. | 273/242 |
| 4,010,954 | 3/1977 | Uding | 273/242 |
| 4,129,304 | 12/1978 | Mager | 273/242 X |
| 4,938,482 | 7/1990 | Ludwick et al. | 273/260 |
| 5,116,062 | 5/1992 | Johnson | 273/260 |

FOREIGN PATENT DOCUMENTS

| | | | |
|---|---|---|---|
| 0946778 | 6/1949 | France | 273/242 |
| 0002023 | of 1871 | United Kingdom | 273/242 |
| 0009963 | of 1897 | United Kingdom | 273/242 |

*Primary Examiner*—V. Millin
*Assistant Examiner*—William E. Stoll

[57] ABSTRACT

A game apparatus comprises a game board having four quadrant areas. Each quadrant area further comprises a plurality of squares of which said squares are blank and labeled. The labeled squares number fourteen per quadrant and the blank squares number twenty two per quadrant. The apparatus also has playing chips. The chips correspond to the labeled squares such that for each labeled square, there exists a playing chip identifying the same label as that on each of the said squares. Dice are rolled to initiate the game and the winner receives a victory sign.

5 Claims, 2 Drawing Sheets

GAME BOARD AND METHOD OF USING SAME

BACKGROUND OF THE INVENTION

The present invention relates to a board game and the method of its play. More particularly, this board game relates to the powers in charge of the government, the corporate sector, white collar professionals and the field and arena of the labor unions. Numerous games have been provided in the prior art that are adapted to be played with skill and are also games of chance. While these devices may be suitable for the particular purposes to which they address, they would not be suitable for the purpose of the present invention as hereinafter described.

SUMMARY OF THE INVENTION

A primary object of the present invention is to provide a plurality of players, up to four (4), with an opportunity to play out the power struggle of various sectors of leadership. Depending upon one's own interest, a player may opt to take the position of government or corporation. On the other hand, that player may choose to side with the labor movement in deciding to become unionized or remain reliant upon corporate management for its benefits' protection.

It is another object of the present invention to learn the steps toward achieving a measure of control in one's job and/or faith in government or corporate employer, while maximizing the player's confidence level.

It is yet another object of the present invention to get the players to examine their own beliefs regarding fairness and equity in the powers of the government, corporate, etc. Even where one has a certain belief, an object of this invention allows that individual to take a contrary position and empathize with a player who must face the problems and difficulties ensnared by that position Thus, it is even still another object of the present invention to achieve a degree of education into one's own belief system with the intent to expand that system.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

DETAILED DESCRIPTION OF THE PREFERRED EMBODIMENT

Figure 1:
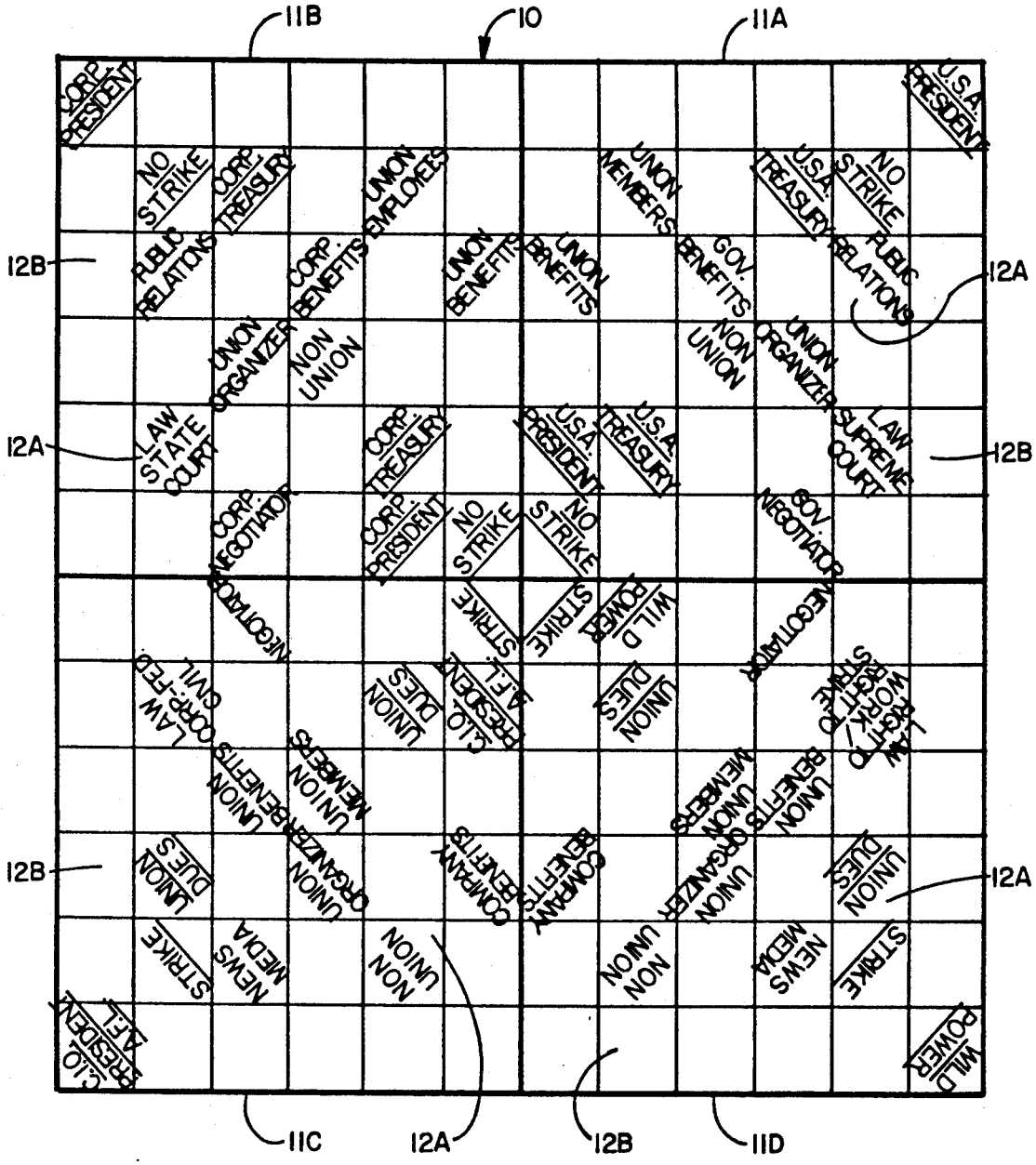
FIG. 1 is a plan view of a game board of the game apparatus constructed in accordance with the present invention.

Referring now to the drawings and more particularly FIG. 1, a game board 10 is shown which is part of the game apparatus in accordance with the present invention, and which is used in accordance with the method of the present invention. The game board is divided into four quadrants 11A, 11B, 11C, and 11D. Each quadrant is comprised of thirty six (36) squares 12 for a total of one hundred forty four (144) squares 12. Of the squares

12, fifty six (56) in number are labeled, 12A, and eighty eight (88) squares are blank, 12B.

The labeled squares 12A of each quadrant are symetrical with respect to the labeled squares 12A of each other quadrant. Thus, if each quadrant were to be overlaid onto the others, the labeled squares 12A would be in the same relative postion for all quadrants as well as that of the blank squares 12B.

Referring to quadrant 11A of FIG. 1 of game board 10, this quadrant relates to the United States government. The labeled squares 12A in this quadrant include:

U.S.A. PRESIDENT
NO STRIKE
U.S.A. TREASURY
PUBLIC RELATIONS
UNION MEMBERS
GOVERNMENT BENEFITS
UNION ORGANIZER
LAW SUPREME COURT
NON UNION
UNION BENEFITS
GOVERNMENT NEGOTIATOR
U.S.A. TREASURY
U.S.A. PRESIDENT
NO STRIKE in their respective locations as disclosed in FIG. 1.

Referring to quadrant 11B of FIG. 1 of game board 10, this quadrant relates to the corporate sector. The labeled squares 12A in this quadrant include:

CORPORATE PRESIDENT
NO STRIKE
PUBLIC RELATIONS
CORPORATE TREASURY
LAW STATE COURT
UNION ORGANIZER
CORPORATE BENEFITS
UNION EMPLOYEES
NON UNION
CORPORATE NEGOTIATOR
UNION BENEFITS
CORPORATE TREASURY
CORPORATE PRESIDENT
NO STRIKE in their respective locations as disclosed in FIG. 1.

Referring to quadrant 11C of FIG. 1 of game board 10, this quadrant relates to the professional environment. The labeled squares 12A in this quadrant include:

A.F.L.C.I.O. PRESIDENT
STRIKE
NEWS' MEDIA
UNION DUES
NON UNION
UNION ORGANIZER
UNION BENEFITS
LAW CORPORATE-FEDERAL CIVIL
UNION MEMBERS
COMPANY BENEFITS
NEGOTIATOR
UNION DUES
A.F.L.C.I.O. PRESIDENT
STRIKE in their respective locations as disclosed in FIG. 1.

Referring to quadrant 11D of FIG. 1 of game board 10, this quadrant relates to the labor power. The labeled squares 12A in this quadrant include:

WILD POWER
STRIKE

Figure 2:
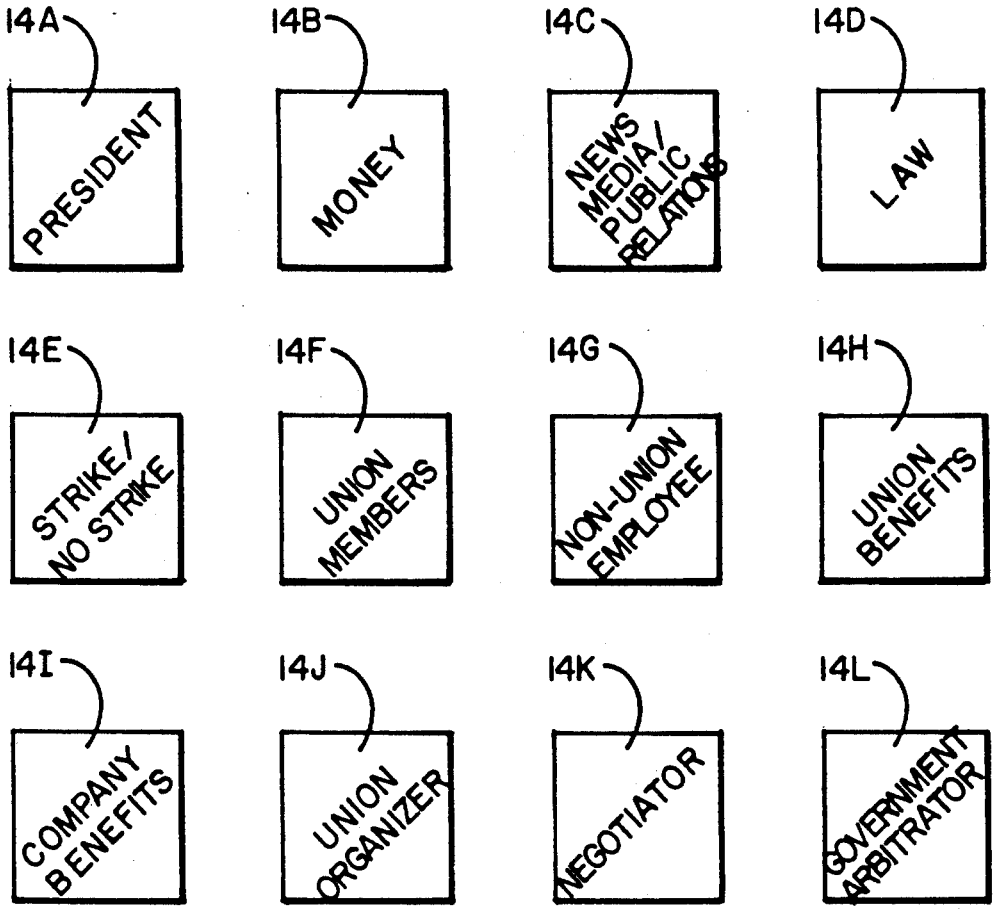
FIG. 2 is a pictorial view of the playing chips for use by a player of the game apparatus of FIG. 1.
Figure 3:
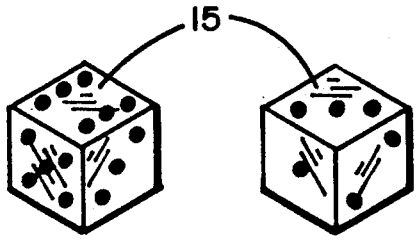
FIG. 3 is a pictorial view of two move determining devices of the game apparatus of FIG. 1.
Figure 4:
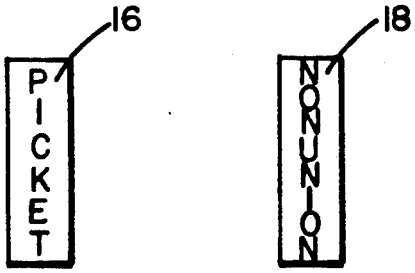
FIG. 4 is a pictorial view of representative signs given to the victor of the game apparatus of FIG. 1.

UNION DUES
NEWS MEDIA
LAW RIGHT TO WORK/RIGHT TO STRIKE
UNIION BENEFITS
UNION ORGANIZER
NON UNION
UNION MEMBERS
NEGOTIATOR
COMPANY BENEFITS
UNION DUES
WILD POWER
STRIKE in their respective locations as disclosed in FIG. 1. The game apparatus also comprises playing chips 14 as are, in part, represented in FIG. 2.

The playing chips 14 included in the present invention include the following: The president chip 14A represents the highest position in the chain of leadership. This chip 14A can represent the government, a corporate president, the union chief or the head of labor; The money chip 14B represents the source of funds needed to finance a labor dispute or to protect an employer's interest or security; The news' media/public relations chip 14C is necessary to dispense current events to the public at large and is a very important function in swaying a negotiation between labor and a public or private employer; The law chip 14D is an indicium of order. Our nation is governed by laws and was built and maintained by law. The people are protected by laws; The strike/no strike chip 14E is the essence of freedom of choice. The employee can vote to express his or her beliefs as to any certain issue; The union members, 14F, non-union employee, 14G, union benefits, 14H, and company benefits, 14I, chips represent an area of extreme differences in opinions of workers and must be played per the point value described below. Each of said chips 14F and 14G, and, 14H and 14I, has an opposing point value, yet equal in its position on the game board 10; The negotiator chip 14K represents the ability to compromise claims and resolve disputes, and; the government arbitrator chip 14L represents the deadlock breaker in case of an impasse in the negotiations.

Dice 15 are used to start the game by enabling the players to choose which side they want to represent: government, corporate, professional, or labor. The winner of the game as discussed below gets to receive his or her choice of a victroy sign, namely, a picket sign 16 or a non union sign 18.

OBJECT OF THE GAME

The object of the game is to move the president chip 14A, the money chip 14B, and the strike/no strike chip 14E onto their respective labeled positions on the game board 10 within their starting quadrant. Thereafter, the object is to move those pieces to the extreme opposite diagonal position. For example, the president chip 14A for the government president in quadrant 11A would be directed to the square marked for the professional president in quadrant 11C, etc. Once any player accomplishes this task, points are scored as hereinbelow described, and the highest point total is the winner. In this case, the winner gets to choose a sign 16 or 18.

PRIOR TO STARTING THE GAME

Each player rolls the six-sided dice 15 which have one of the numbers one (1) through six (6) on each side. The lowest total number has the first opportunity to select which position in the quadrants 11A–D he or she would like to represent. Thereafter, in ascending numerical order, the other quadrants are selected. The last player to choose a quadrant gets to make the first move.

Once the quadrants have been selected, the playing chips 14 are placed on the game board 10. Each player has eleven playing chips 14 corresponding to the eleven different labeled squares 12A in their respective quadrant.

The playing chips 14 are initially situated such that the president chip 14A is placed on the labeled square 12A located on each corner of the game board 10. Then, depending upon a player's choice, the remaining ten playing chips 14 are placed on both sides of the president chip 14A thus forming an "L" shape.

MOVEMENT OF THE PLAYING CHIPS

The playing chips 14 of each quadrant 11A–D are moved one square at a time, with players alternating turns in clocklike direction beginning with the last player to select a quadrant as set forth above. Each playing chip 14A–K must first be moved onto its corresponding labeled square 12A within its own quadrant before it may be moved to other quadrants. The playing chips 14 may be moved on any square, labeled 12A or blank 12B.

SCORING

As described above, the object of the game is get the playing chips 14A, 14B and 14E onto the diagonal opponent's opposite corresponding labeled squares 12A. In so doing, it is likely that playing chips 14 will be moved to adjacent squares. When this occurs, it may be possible to have the playing chip of the next player in rotation, jump the adjacent playing chip, but only if its value is equal to or higher than that of the adjacent playing chip, according to the numbered value system below:

| | POINTS | | POINTS |
|---|---|---|---|
| GOVERNMENT | | CORPORATE | |
| U.S.A. PRESIDENT | 12 | CORP. PRESIDENT | 12 |
| U.S.A. TREASURY | 11 | CORP. TREASURY | 11 |
| PUBLIC RELATIONS | 10 | PUBLIC RELATIONS | 10 |
| SUPREME COURT | 9 | STATE COURT | 9 |
| NO STRIKE | 8 | NO STRIKE | 8 |
| FED. NON UNION | 7 | CORP. NON UNION | 7 |
| GOVT. BENEFITS | 6 | CORP. BENEFITS | 6 |
| GOVT. NEGOTIATOR | 5 | CORP. NEGOTIATOR | 5 |
| UNION ORGANIZER | 4 | UNION ORGANIZER | 4 |
| FED. UNION MEMBER | 3 | CORP. UN. EMP. | 3 |
| UNION BENEFITS | 2 | UNION BENEFITS | 2 |
| *GOVT. ARBITRATOR | 8 | LABOR | |
| PROFESSIONAL | | WILD FULL POWER | 12 |

-continued

| | POINTS | | POINTS |
|---|---|---|---|
| AFL-CIO PRESIDENT | 12 | UNION DUES | 11 |
| UNION DUES | 11 | NEWS MEDIA-T.V. | 10 |
| NEWS MEDIA-T.V. | 10 | LAW-RIGHT TO WORK/ | 9 |
| LAW-FEDERAL-CIVIL | 9 | RIGHT TO STRIKE | |
| STRIKE | 8 | STRIKE | 8 |
| PROF. UNION MEM. | 7 | LABOR UNION MEM. | 7 |
| UNION BENEFITS | 6 | UNION BENEFITS | 6 |
| NEGOTIATOR | 5 | NEGOTIATOR-UNION | 5 |
| UNION ORGANIZER | 4 | UNION ORGANIZER | 4 |
| PROF. NON UNION | 3 | NON UNION EMP. | 3 |
| COMPANY BENEFITS | 2 | COMPANY BENEFITS | 2 |

After the jump, the playing chip jumped is acquired by the jumping player and the point value ultimately scored by the jumping player. In the case of a deadlock, when no moves can be played by any player, the government player may substitute the government arbitrator chip 14L for the government negotiator chip 14K. The differential in point value breaks the deadlock. If another deadlock occurs, then the game is a draw.

THE WIN

As disclosed above, once a player moves his or her president chip 14A, money chip 14B, and strike/no strike chip 14E to the opposite corner, the game is over and the chip value tallied. Twelve, eleven, and ten points are awarded to the player who has moved his 14A, 14B, and 14E chips, respectively, to the opposite corner of the game board 10. Add to this value the total points of playing chips 14 acquired during the game's play. Finally, add the points of the player's playing chips 14 which, at the game's end, is on the corresponding labeled squares 12A of the player's diagonal opponent. The sum of these three subtotals is the grand total. The highest grand total player is the victor.

However, if during the play of the game, one of either the president, money or strike/no strike chips, 14A, 14B or 14E, respectively, has been acquired by another player, such that no player has all three chips remaining, a compromise may be entered where the highest point total wins the game. The highest point total in this regard will be counted at the time when the last of the players loses any one of the three chips, 14A, 14B or 14E. In this case, where there is a compromise, the highest winning point total player does not get to receive a victory sign 16 or 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A game apparatus, comprising, in combination, a game board, said game board having four quadrant areas, each of said quadrant area comprising a plurality of squares of which said squares are blank and labeled such that the labeled squares number fourteen per quadrant and the blank squares number twenty two per quadrant, playing chips, such that said chips correspond to the said labeled squares such that for each labeled square, there exists a playing chip identifying the same label as that on the said square, however, to the exclusion of three playing chips, namely, President, Money and Strike/No Strike, for which there are two labeled squares per chip; and a Government Arbitrator playing chip, for which there is no corresponding labeled square on said game board;

dice for initiating the selection and movement of the said playing chips, and;

a victory sign to be awarded to the winner of said game apparatus.

2. The game apparatus of claim 1, wherein said quadrants represent the government, the professional, the corporate and the labor sectors.

3. The game apparatus of claim 1, wherein if each of said quadrants were overlaid onto one another, the labeled squares of each of said quadrants would be in the same position as the labeled squares of the other of the said quadrants.

4. The game apparatus of claim 3, wherein said overlay would result in the said labeled squares having an equal corresponding point value.

5. The game apparatus of claim 1, such that said playing chips are individually identified and given corresponding point values, such that said point values are as follows:

| | POINTS | | POINTS |
|---|---|---|---|
| GOVERNMENT | | CORPORATE | |
| U.S.A. PRESIDENT | 12 | CORP. PRESIDENT | 12 |
| U.S.A. TREASURY | 11 | CORP. TREASURY | 11 |
| PUBLIC RELATIONS | 10 | PUBLIC RELATIONS | 10 |
| SUPREME COURT | 9 | STATE COURT | 9 |
| NO STRIKE | 8 | NO STRIKE | 8 |
| FED. NON UNION | 7 | CORP. NON UNION | 7 |
| GOVT. BENEFITS | 6 | CORP. BENEFITS | 6 |
| GOVT. NEGOTIATOR | 5 | CORP. NEGOTIATOR | 5 |
| UNION ORGANIZER | 4 | UNION ORGANIZER | 4 |
| FED. UNION MEMBER | 3 | CORP. UN. EMP. | 3 |
| UNION BENEFITS | 2 | UNION BENEFITS | 2 |
| *GOVT. ARBITRATOR | 8 | LABOR | |
| PROFESSIONAL | | WILD FULL POWER | 12 |
| AFL-CIO PRESIDENT | 12 | UNION DUES | 11 |

-continued

| | POINTS | | POINTS |
|---|---|---|---|
| UNION DUES | 11 | NEWS MEDIA-T.V. | 10 |
| NEWS MEDIA-T.V. | 10 | LAW-RIGHT TO WORK/ | 9 |
| LAW-FEDERAL-CIVIL | 9 | RIGHT TO STRIKE | |
| STRIKE | 8 | STRIKE | 8 |
| PROF. UNION MEM. | 7 | LABOR UNION MEM. | 7 |
| UNION BENEFITS | 6 | UNION BENEFITS | 6 |
| NEGOTIATOR | 5 | NEGOTIATOR-UNION | 5 |
| UNION ORGANIZER | 4 | UNION ORGANIZER | 4 |
| PROF. NON UNION | 3 | NON UNION EMP. | 3 |
| COMPANY BENEFITS | 2 | COMPANY BENEFITS | 2 |

* * * * *